US010711727B2

(12) United States Patent
Satake et al.

(10) Patent No.: US 10,711,727 B2
(45) Date of Patent: Jul. 14, 2020

(54) FUEL INJECTION CONTROL DEVICE

(71) Applicant: TOYOTA JIDOSHA KABUSHIKI KAISHA, Toyota-shi, Aichi-ken (JP)

(72) Inventors: Nobuyuki Satake, Kariya (JP); Tomohiro Nakano, Nagoya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 24 days.

(21) Appl. No.: 16/092,994

(22) PCT Filed: Apr. 7, 2017

(86) PCT No.: PCT/JP2017/014475
§ 371 (c)(1),
(2) Date: Oct. 11, 2018

(87) PCT Pub. No.: WO2017/191732
PCT Pub. Date: Nov. 9, 2017

(65) Prior Publication Data

US 2019/0195163 A1 Jun. 27, 2019

(30) Foreign Application Priority Data

May 6, 2016 (JP) ..... 2016-093319

(51) Int. Cl.
*F02D 41/40* (2006.01)
*F02D 41/24* (2006.01)
(Continued)

(52) U.S. Cl.
CPC ..... *F02D 41/40* (2013.01); *F02D 41/20* (2013.01); *F02D 41/247* (2013.01);
(Continued)

(58) Field of Classification Search
CPC ..... F02D 41/20; F02D 41/247; F02D 41/40; F02D 2041/2055; F02D 2200/0614; F02D 2200/0616; F02M 65/001
See application file for complete search history.

(56) References Cited

U.S. PATENT DOCUMENTS

2009/0056676 A1 3/2009 Nakata et al.
2016/0245211 A1 8/2016 Katsurahara et al.

FOREIGN PATENT DOCUMENTS

EP 1172542 A2 1/2002
JP H06-272598 A 9/1994
(Continued)

OTHER PUBLICATIONS

May 16, 2019 Office Action issued in European Patent Application No. 17 792 665.6.
(Continued)

*Primary Examiner* — Hung Q Nguyen
*Assistant Examiner* — Mark L. Greene
(74) *Attorney, Agent, or Firm* — Oliff PLC

(57) ABSTRACT

A fuel injection control device includes a conduction time calculation unit, a detection unit, an estimation unit, a correction unit, a sudden change determination unit, and a reflection speed setting unit. The detection unit detects a physical quantity having a correlation with an actual injection quantity during the partial lift injection. The estimation unit estimates the actual injection quantity on the basis of a detection result of the detection unit. The correction unit corrects the requested injection quantity by a correction quantity corresponding to a deviation between the actual injection quantity and the requested injection quantity. The sudden change determination unit determines whether or not the correction quantity is in a sudden change state on the basis of whether or not the correction quantity has changed
(Continued)

from a previous value by a prescribed quantity or more. The reflection speed setting unit sets the reflection speed.

7 Claims, 10 Drawing Sheets

(51) Int. Cl.
*F02D 41/20* (2006.01)
*F02M 65/00* (2006.01)

(52) U.S. Cl.
CPC ... *F02M 65/001* (2013.01); *F02D 2041/2055* (2013.01); *F02D 2200/0616* (2013.01)

(56) References Cited

FOREIGN PATENT DOCUMENTS

| | | | |
|---|---|---|---|
| JP | 2012-172517 | A | 9/2012 |
| JP | 2013-174174 | A | 9/2013 |
| WO | 2013/191267 | A1 | 12/2013 |
| WO | 2017/191728 | A1 | 11/2017 |
| WO | 2017/191729 | A1 | 11/2017 |
| WO | 2017/191730 | A1 | 11/2017 |
| WO | 2017/191731 | A1 | 11/2017 |
| WO | 2017/191733 | A1 | 11/2017 |

OTHER PUBLICATIONS

Jun. 20, 2017 International Search Report issued in International Patent Application PCT/JP2017/014475.
Jun. 20, 2017 Written Opinion issued in International Patent Application PCT/JP2017/014475.

FUEL INJECTION CONTROL DEVICE

CROSS REFERENCE TO RELATED APPLICATION

This application is based on Japanese Patent Application No. 2016-93319 filed on May 6, 2016, the disclosure of which is incorporated herein by reference.

TECHNICAL FIELD

The present disclosure relates to a fuel injection control device to control an injection quantity of a fuel injected through a fuel injection valve.

BACKGROUND ART

In Patent Literature 1, a fuel injection valve to inject a fuel by operating a valve body for valve opening with an electric actuator is disclosed. Further, a fuel injection control device to control a valve opening time of a valve body by controlling a time for energizing an electric actuator and thus control an injection quantity injected per one time valve opening of the valve body is disclosed. A conduction time is set at a time corresponding to an injection quantity that is requested (requested injection quantity).

A conduction time (namely injection characteristic) corresponding to a requested injection quantity changes however by aging such as wear resulting at various parts of a fuel injection valve. In recent years therefore, development of a technology of estimating an injection quantity injected actually (namely actual injection quantity) by detecting a physical quantity, for example a terminal voltage change of an electric actuator, having a correlation with the actual injection quantity advances. According to the technology, a requested injection quantity can be corrected by a correction quantity corresponding to a deviation between an actual injection quantity and the requested injection quantity so as to eliminate the deviation. Consequently, a conduction time corresponding to the change of an injection characteristic by aging can be obtained and hence an injection quantity can be controlled with a high degree of accuracy.

PRIOR ART LITERATURES

Patent Literature

Patent Literature 1: JP2015-96720A

SUMMARY OF INVENTION

Meanwhile, in recent years, the development of partial lift injection (refer to Patent Literature 1) in which a valve body starts valve closing operation before the valve body reaches a maximum valve opening position after the valve body starts valve opening operation advances and, on this occasion, the behavior of the valve body in opening and closing operations is destabilized. In the partial lift injection therefore, estimation accuracy in detecting a terminal voltage change and estimating an actual injection quantity is poor. If a correction quantity is immediately reflected on a requested injection quantity therefore, highly accurate control of an injection quantity cannot sufficiently be promoted.

Then the present inventors have studied to make the poor estimation accuracy hardly reflected on injection quantity control even in the partial lift injection by reflecting a correction quantity on a requested injection quantity gradually for a prescribed period of time.

Besides the change of an injection characteristic by aging however, it sometimes happens that an injection characteristic may change in response to the exchange of a fuel injection valve. On this occasion, a correction quantity changes suddenly but, with the above control of not immediately reflecting a correction quantity, a correction quantity that has changed suddenly in response to the exchange is not immediately reflected. Consequently, the disadvantage that it takes time to reflect a correction quantity immediately after exchange is larger than the advantage that the poor estimation accuracy is hardly reflected in the partial lift injection.

An object of the present disclosure is to provide a fuel injection control device that attempts to deal with both of the change of an injection characteristic by aging and the exchange of a fuel injection valve.

According to an aspect of the present disclosure, the fuel injection control device is applied to a fuel injection valve to operate for valve opening a valve body to open and close an injection hole to inject a fuel by an electric actuator, controls a valve opening time of the valve body by controlling the operation of the electric actuator, and thus controls an injection quantity injected per one time valve opening of the valve body. The fuel injection control device includes a conduction time calculation unit to calculate a conduction time of the electric actuator corresponding to a requested injection quantity that is an injection quantity requested during partial lift injection in which the valve body starts valve closing operation before the valve body reaches a maximum valve opening position after the valve body starts valve opening operation, a detection unit to detect a physical quantity having a correlation with an actual injection quantity that is an injection quantity injected actually during the partial lift injection, an estimation unit to estimate the actual injection quantity on the basis of a detection result of the detection unit, a correction unit to correct the requested injection quantity by a correction quantity corresponding to a deviation between the actual injection quantity estimated by the estimation unit and the requested injection quantity, a sudden change determination unit to determine whether or not the correction quantity is in a sudden change state on the basis of whether or not the correction quantity has changed from a previous value by a prescribed quantity or more, and a reflection speed setting unit to set a reflection speed at which the correction unit reflects the correction quantity on the requested injection quantity gradually for a prescribed period of time. The reflection speed setting unit sets the reflecting speed when the sudden change determination unit determines a correction quantity to be in the sudden change state at a speed higher than a speed when the correction quantity is determined not to be in the sudden change state.

According to the above disclosure, whether or not a correction quantity is in a state of suddenly changing is determined and, when the correction quantity is determined to be in a sudden change state, the reflection speed of reflecting the correction quantity on a requested injection quantity gradually for a prescribed period of time is increased. Consequently, when an injection characteristic changes in response to the exchange of the fuel injection valve, the situation is determined to be in a sudden change state and the reflection speed increases and hence a correction quantity that has changed suddenly by the exchange can be reflected rapidly. In the state, when an injection characteristic changes by aging, a correction unit reflects the correction quantity on a requested injection quantity gradually for a prescribed period of time. As a result, in reflecting a correction quantity that changes by aging, poor estimation accuracy in partial lift injection is hardly reflected. According to the present embodiment therefore, it is possible to attempt to deal with both of the change of an injection characteristic by aging and the exchange of the fuel injection valve.

BRIEF DESCRIPTION OF DRAWINGS

The above and other objects, features and advantages of the present disclosure will become more apparent from the following detailed description made with reference to the accompanying drawings. In the drawings.

DESCRIPTION OF EMBODIMENTS

Figure 1:
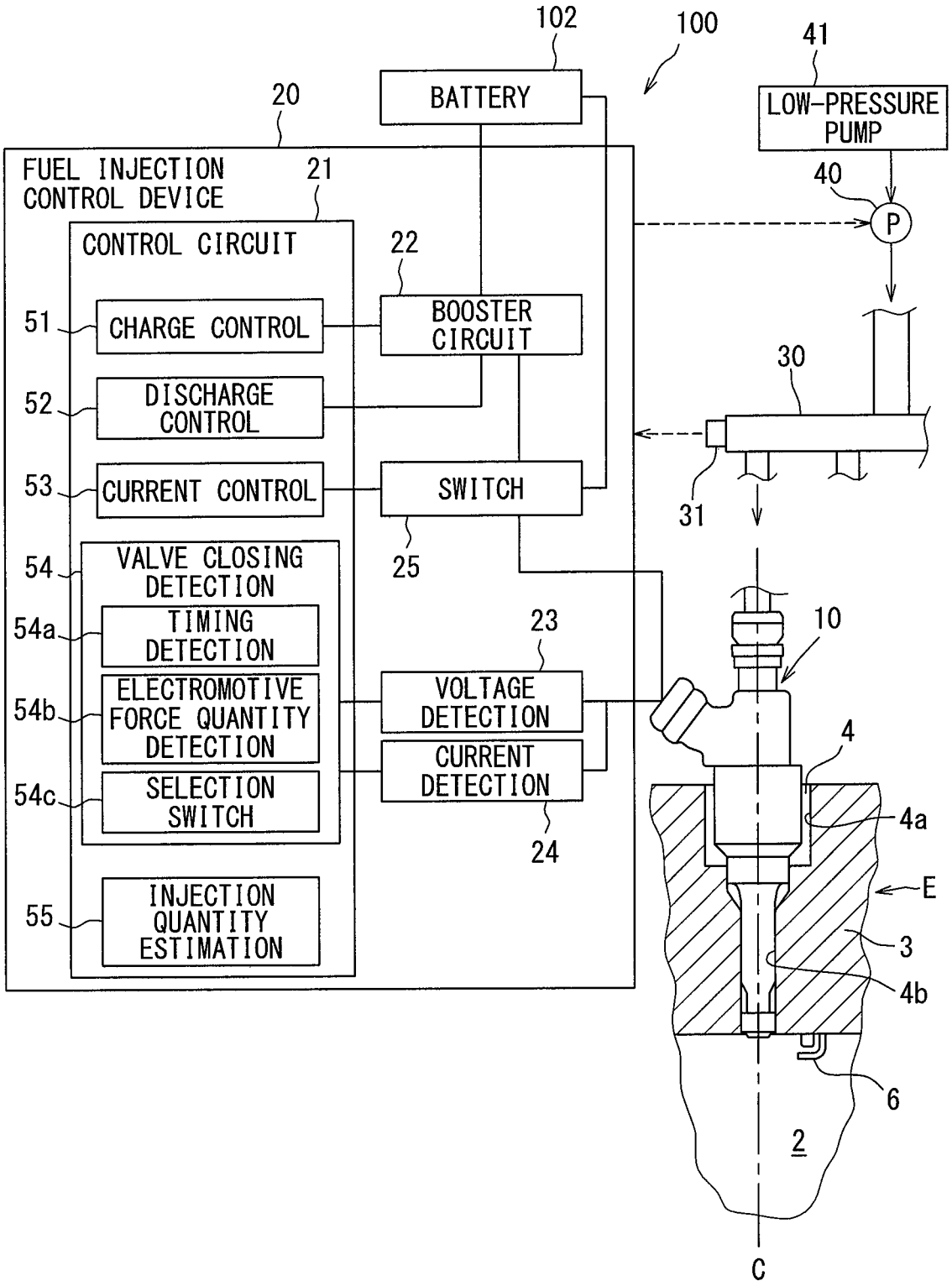
FIG. 1 is a view showing a fuel injection system according to a first embodiment.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration.

First Embodiment

A first embodiment according to the present disclosure is explained in reference to FIGS. 1 to 10. A fuel injection system 100 shown in FIG. 1 includes a plurality of fuel injection valves 10 and a fuel injection control device 20. The fuel injection control device 20 controls the opening and closing of the fuel injection valves 10 and controls fuel injection into a combustion chamber 2 of an internal combustion engine E. The fuel injection valves 10: are installed in an internal combustion engine E of an ignition type, for example a gasoline engine; and inject a fuel directly into a plurality of combustion chambers 2 of the internal combustion engine E respectively. A mounting hole 4 penetrating concentrically with an axis C of a cylinder is formed in a cylinder head 3 constituting the combustion chamber 2. A fuel injection valve 10 is inserted into and fixed to the mounting hole 4 so that the tip may be exposed into the combustion chamber 2.

A fuel supplied to the fuel injection valve 10 is stored in a fuel tank not shown in the figure. The fuel in the fuel tank is pumped up by a low-pressure pump 41, the fuel pressure is raised by a high-pressure pump 40, and the fuel is sent to a delivery pipe 30. The high-pressure fuel in the delivery pipe 30 is distributed and supplied to the fuel injection valve 10 of each cylinder. A spark plug 6 is attached to a position of the cylinder head 3 facing the combustion chamber 2. Further, the spark plug 6 is arranged in a vicinity of the tip of the fuel injection valve 10.

Figure 2:
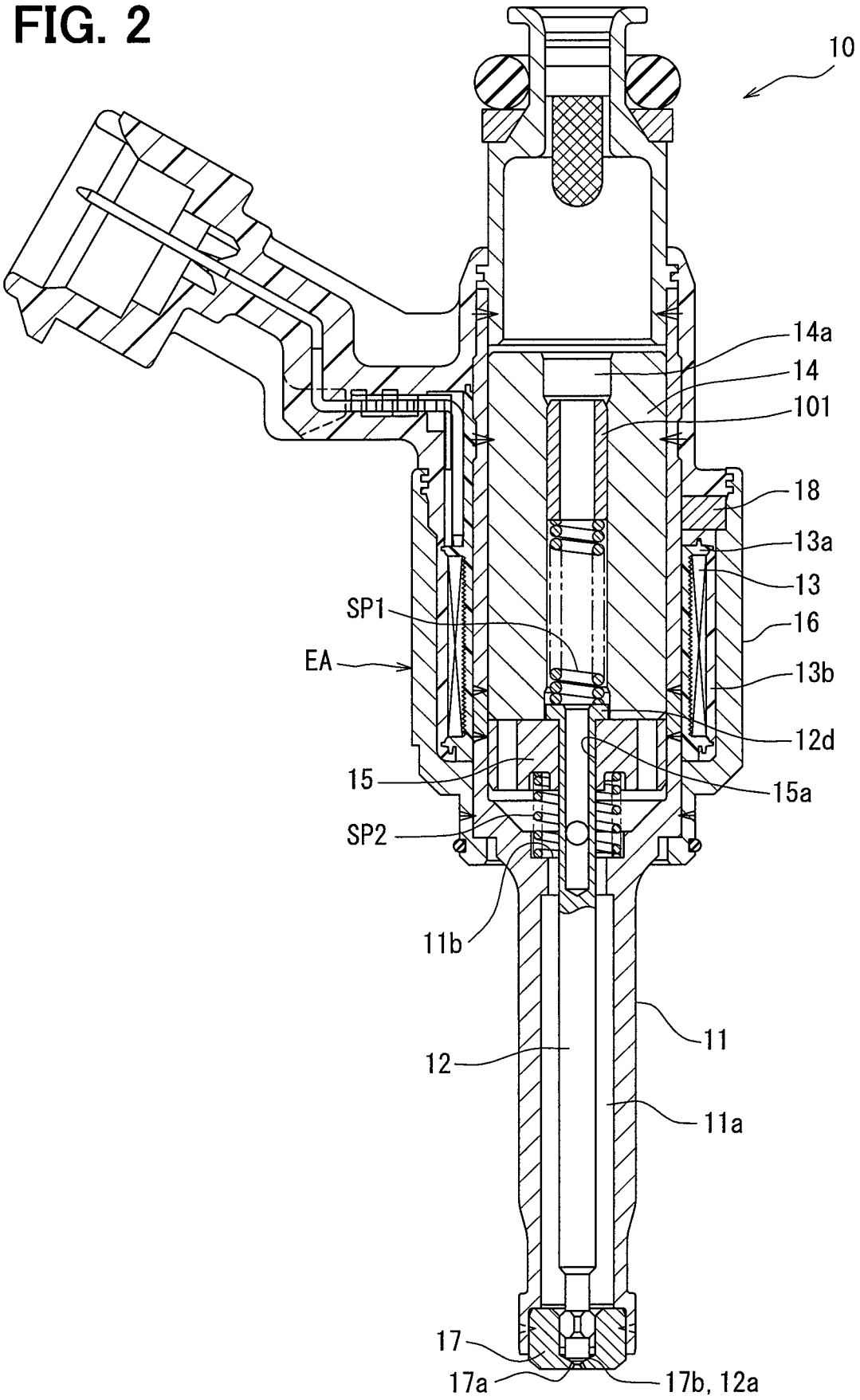
FIG. 2 is a sectional view showing a fuel injection valve.

The configuration of the fuel injection valve 10 is explained hereunder in reference to FIG. 2. As shown in FIG. 2, the fuel injection valve 10 includes a body 11, a valve body 12, an electromagnetic coil 13, a stator core 14, a movable core 15, and a housing 16. The body 11 comprises a magnetic material. A fuel passage 11*a* is formed in the interior of the body 11.

Further, the valve body 12 is contained in the interior of the body 11. The valve body 12 comprises a metal material and is formed cylindrically as a whole. The valve body 12 can be displaced reciprocally in an axial direction in the interior of the body 11. The body 11 is configured so as to have an injection hole body 17 in which a valve seat 17*b* where the valve body 12 is seated and an injection hole 17*a* to inject a fuel are formed at the tip part. The injection hole 17*a* includes a plurality of holes formed radially from the inside toward the outside of the body 11. A fuel of a high pressure is injected into the combustion chamber 2 through the injection hole 17*a*.

The main body part of the valve body 12 has a columnar shape. The tip part of the valve body 12 has a conical shape extending from the tip of the main body part on the side of the injection hole 17*a* toward the injection hole 17*a*. The part, which is seated on the valve seat 17*b*, of the valve body 12 is a seat surface 12*a*. The seat surface 12*a* is formed at the tip part of the valve body 12.

When the valve body 12 is operated for valve closing so as to seat the seat surface 12*a* on the valve seat 17*b*, the fuel passage 11*a* is closed and fuel injection from the injection hole 17*a* is stopped. When the valve body 12 is operated for valve opening so as to separate the seat surface 12*a* from the valve seat 17*b*, the fuel passage 11*a* is open and a fuel is injected through the injection hole 17*a*.

The electromagnetic coil 13 is an actuator and gives a magnetic attraction force to the movable core 15 in a valve opening direction. The electromagnetic coil 13 is configured by being wound around a resin-made bobbin 13*a* and is sealed by the bobbin 13*a* and a resin material 13*b*. In other words, a coil body of a cylindrical shape includes the electromagnetic coil 13, the bobbin 13*a*, and the resin material 13*b*. The bobbin 13*a* is inserted over the outer peripheral surface of the body 11. The stator core 14 comprises a magnetic material and is formed cylindrically and is fixed to the body 11. A fuel passage 14*a* is formed in the interior of the cylinder of the stator core 14.

Further, the outer peripheral surface of the resin material 13*b* to seal the electromagnetic coil 13 is covered with the housing 16. The housing 16 comprises a metallic magnetic material and is formed cylindrically. A lid member 18 comprising a metallic magnetic material is attached to an opening end part of the housing 16. Consequently, the coil body is surrounded by the body 11, the housing 16, and the lid member 18.

The movable core 15 is a mover and is retained by the valve body 12 relatively displaceably in the direction of driving the valve body 12. The movable core 15 comprises a metallic magnetic material, is formed discoidally, and is inserted over the inner peripheral surface of the body 11. The body 11, the valve body 12, the coil body, the stator core 14, the movable core 15, and the housing 16 are arranged so that the center lines of them may coincide with each other. Then the movable core 15 is arranged on the side of the stator core 14 closer to the injection hole 17*a* and faces the stator core 14 in the manner of having a prescribed gap from the stator core 14 when the electromagnetic coil 13 is not conducted.

The body 11, the housing 16, the lid member 18, and the stator core 14, which surround the coil body: comprise magnetic materials as stated earlier; and hence form a magnetic circuit acting as a pathway of a magnetic flux generated when the drive coil 13 is conducted. Components such as the stator core 14, the movable core 15, the electromagnetic coil 13, and the like correspond to an electric actuator EA to operate the valve body 12 for valve opening.

As shown in FIG. 1, the outer peripheral surface of a part of the body 11 located on the side closer to the injection hole 17*a* than the housing 16 is in contact with an inner peripheral surface 4*b* of the mounting hole 4 on the lower side. Further, the outer peripheral surface of the housing 16 forms a gap from an inner peripheral surface 4*a* of the mounting hole 4 on the upper side.

A through hole 15*a* is formed in the movable core 15 and, by inserting the valve body 12 into the through hole 15*a*, the valve body 12 is assembled to the movable core 15 slidably and relatively movably. A locking part 12*d* formed by expanding the diameter from the main body part is formed at an end part, which is located on the upper side in FIG. 2, of the valve body 12 on the side opposite to the injection hole. When the movable core 15 is attracted by the stator core 14 and moves upward, the locking part 12*d* moves in the state of being locked to the movable core 15 and hence the valve body 12 also moves in response to the upward movement of the movable core 15. Even in the state of bringing the movable core 15 into contact with the stator core 14, the valve body 12 can move relatively to the movable core 15 and can lift up.

A main spring SP1 is arranged on the side of the valve body 12 opposite to the injection hole and a sub spring SP2 is arranged on the side of the movable core 15 closer to the injection hole 17*a*. The main spring SP1 and the sub spring SP2 are coil-shaped and deform resiliently in an axial direction. A resilient force of the main spring SP1 is given to the valve body 12 in the direction of valve closing that is the downward direction in FIG. 2 as a counter force coming from an adjustment pipe 101. A resilient force of the sub spring SP2 is given to the movable core 15 in the direction of attracting the movable core 15 as a counter force coming from a recess 11*b* of the body 11.

In short, the valve body 12 is interposed between the main spring SP1 and the valve seat 17*b* and the movable core 15 is interposed between the sub spring SP2 and the locking part 12*d*. Then the resilient force of the sub spring SP2 is transferred to the locking part 12*d* through the movable core 15 and is given to the valve body 12 in the direction of valve opening. It can also be said therefore that a resilient force obtained by subtracting a sub resilient force from a main resilient force is given to the valve body 12 in the direction of valve closing.

Here, the pressure of a fuel in the fuel passage 11*a* is applied to the whole surface of the valve body 12 but a force of pushing the valve body 12 toward the valve closing side is larger than a force of pushing the valve body 12 toward the valve opening side. The valve body 12 therefore is pushed by the fuel pressure in the direction of valve closing. During valve closing, the fuel pressure is not applied to the surface of a part of the valve body 12 located on the downstream side of the seat surface 12*a*. Then along with valve opening, the pressure of a fuel flowing into the tip part increases gradually and a force of pushing the tip part toward valve opening side increases. The fuel pressure in the vicinity of the tip part therefore increases in accordance with the valve opening and resultantly the fuel pressure valve closing force decreases. For the above reason, the fuel pressure valve closing force is maximum during valve closing and reduces gradually as the degree of the movement of the valve body 12 toward valve opening increases.

The behavior of the electromagnetic coil 13 by conduction is explained hereunder. When the electromagnetic coil 13 is conducted and an electromagnetic attraction force is generated in the stator core 14, the movable core 15 is attracted toward the stator core 14 by the electromagnetic attraction force. The electromagnetic attraction force is also called an electromagnetic force. As a result, the valve body 12 connected to the movable core 15 operates for valve opening against the resilient force of the main spring SP1 and the fuel pressure valve closing force. On the other hand, when the conduction of the electromagnetic coil 13 is stopped, the valve body 12 operates for valve closing together with the movable core 15 by the resilient force of the main spring SP1.

The configuration of the fuel injection control device 20 is explained hereunder. The fuel injection control device 20 is operated by an electronic control unit (called ECU for short). The fuel injection control device 20 includes a control circuit 21, a booster circuit 22, a voltage detection unit 23, a current detection unit 24, and a switch unit 25. The control circuit 21 is also called a microcomputer. The fuel injection control device 20 receives information from various sensors. For example, a fuel pressure supplied to the fuel injection valve 10 is detected by a fuel pressure sensor 31 attached to the delivery pipe 30 and the detection result is given to the fuel injection control device 20 as shown in FIG. 1. The fuel injection control device 20 controls the drive of the high-pressure pump 40 on the basis of the detection result of the fuel pressure sensor 31.

The control circuit 21 includes a central processing unit, a non-volatile memory (ROM), a volatile memory (RAM), and the like and calculates a requested injection quantity and a requested injection start time of a fuel on the basis of a load and a machine rotational speed of an internal combustion engine E. The storage mediums such as a ROM and a RAM are non-transitive tangible storage mediums to non-temporarily store programs and data that are readable by a computer. The control circuit 21: functions as an injection control unit; tests and stores an injection characteristic showing a relationship between a conduction time Ti and an injection quantity Q in the ROM beforehand; controls the conduction time Ti to the electromagnetic coil 13 in accordance with the injection characteristic; and thus controls the injection quantity Q. The control circuit 21 outputs an injection command pulse that is a pulse signal to command conduction to the electromagnetic coil 13 and the conduction time of the electromagnetic coil 13 is controlled by a pulse-on period (pulse width) of the pulse signal.

The voltage detection unit 23 and the current detection unit 24 detect a voltage and an electric current applied to the electromagnetic coil 13 and give the detection results to the control circuit 21. The voltage detection unit 23 detects a minus terminal voltage of the electromagnetic coil 13. When an electric current supplied to the electromagnetic coil 13 is intercepted, a flyback voltage is generated in the electromagnetic coil 13. Further, in the electromagnetic coil 13, an induced electromotive force is generated by intercepting the electric current and displacing the valve body 12 and the movable core 15 in the valve closing direction. In accordance with the turn-off of the conduction to the electromagnetic coil 13 therefore, a voltage of a value obtained by overlapping a voltage caused by the induced electromotive force to the flyback voltage is generated in the electromagnetic coil 13. It can accordingly be said that the voltage detection unit 23 detects the variation of an induced electromotive force caused by intercepting an electric current supplied to the electromagnetic coil 13 and displacing the valve body 12 and the movable core 15 toward the valve closing direction as a voltage value. Further, the voltage detection unit 23 detects the variation of an induced electromotive force caused by displacing the movable core 15 relatively to the valve body 12 after the valve seat 17*b* comes into contact with the valve body 12 as a voltage value. A valve closing detection unit 54 detects a valve closing timing when the valve body 12 shifts for valve closing by using a detected voltage. The valve closing detection unit 54 detects a valve closing timing for the fuel injection valve 10 in every cylinder.

The control circuit 21 has a charge control unit 51, a discharge control unit 52, a current control unit 53, the valve closing detection unit 54, and an injection quantity estimation unit 55. The booster circuit 22 and the switch unit 25 operate on the basis of an injection command signal outputted from the control circuit 21. The injection command signal is a signal to command a conduction state of the electromagnetic coil 13 in the fuel injection valve 10 and is set by using a requested injection quantity and a requested injection start time.

The booster circuit 22 applies a boosted boost voltage to the electromagnetic coil 13. The booster circuit 22 has a booster coil, a condenser, and a switching element, a battery voltage applied from a battery terminal of a battery 102 is boosted by the booster coil, and the electricity is stored in the condenser. The voltage of the electric power boosted and stored in this way corresponds to a boost voltage.

When the discharge control unit 52 turns on a prescribed switching element so that the booster circuit 22 may discharge electricity, a boost voltage is applied to the electromagnetic coil 13 in the fuel injection valve 10. The discharge control unit 52 turns off the prescribed switching element in the booster circuit 22 when voltage application to the electromagnetic coil 13 stops.

The current control unit 53 controls on or off of the switch unit 25 and controls the electric current flowing in the electromagnetic coil 13 by using a detection result of the current detection unit 24. The switch unit 25 applies a battery voltage or a boost voltage from the booster circuit 22 to the electromagnetic coil 13 in an on state and stops the application in an off state. The current control unit 53, at a voltage application start time commanded by an injection command signal for example: turns on the switch unit 25; applies a boost voltage; and starts conduction. Then a coil current increases in accordance with the start of the conduction. Then the current control unit 53 turns off the conduction when a detected coil current value reaches a target value on the basis of a detection result of the current detection unit 24. In short, the current control unit 53 controls a coil current so as to be raised to a target value by applying a boost voltage through initial conduction. Further, the current control unit 53 controls conduction by a battery voltage so that a coil current may be maintained at a value lower than a target value after a boost voltage is applied.

Figure 3:
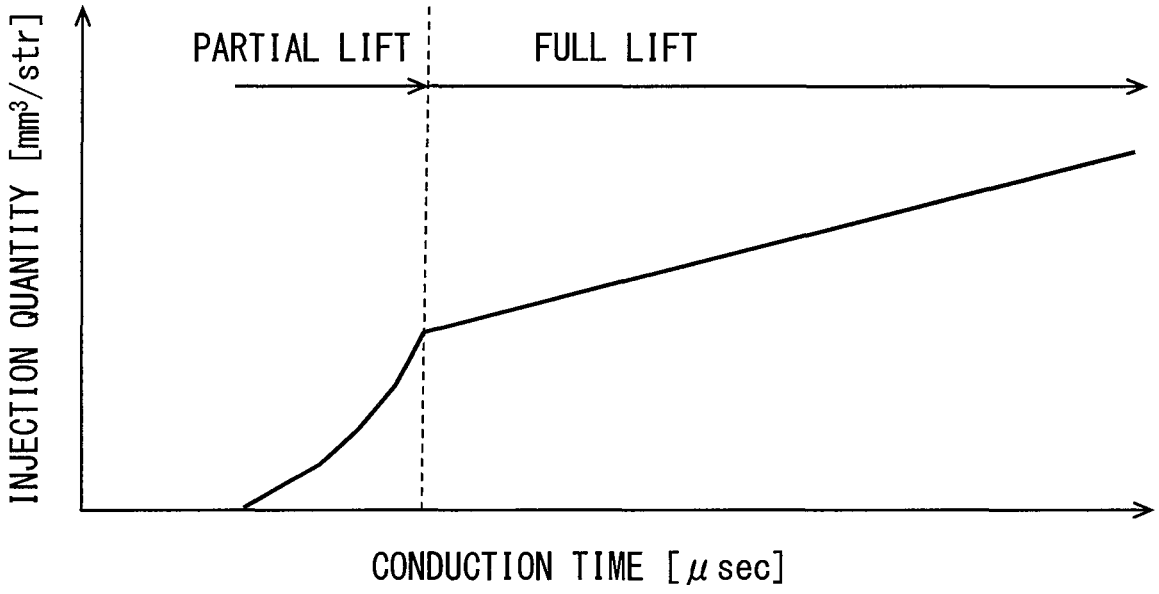
FIG. 3 is a graph showing a relationship between a conduction time and an injection quantity.

As shown in FIG. 3, an injection characteristic map representing a relationship between an injection command pulse width and an injection quantity is classified into a full lift region where an injection command pulse width is relatively large and a partial lift region where an injection command pulse width is relatively small. In the full lift region, the valve body 12: operates for valve opening until the lift quantity of the valve body 12 reaches a full lift position, namely a position where the movable core 15 abuts on the stator core 14; and stars operating for valve closing from the abutting position. In the partial lift region however, the valve body 12: operates for valve opening in a partial lift state where the lift quantity of the valve body 12 does not reach the full lift position, in other words to a position before the movable core 15 abuts on the stator core 14; and starts operating for valve closing from the partial lift position.

The fuel injection control device 20, in a full lift region, executes full lift injection of driving the fuel injection valve 10 for valve opening by an injection command pulse allowing the lift quantity of the valve body 12 to reach a full lift position. Further, the fuel injection control device 20, in a partial lift region, executes partial lift injection of driving the fuel injection valve 10 for valve opening by an injection command pulse causing a partial lift state where the lift quantity of the valve body 12 does not reach a full lift position.

Figure 4:
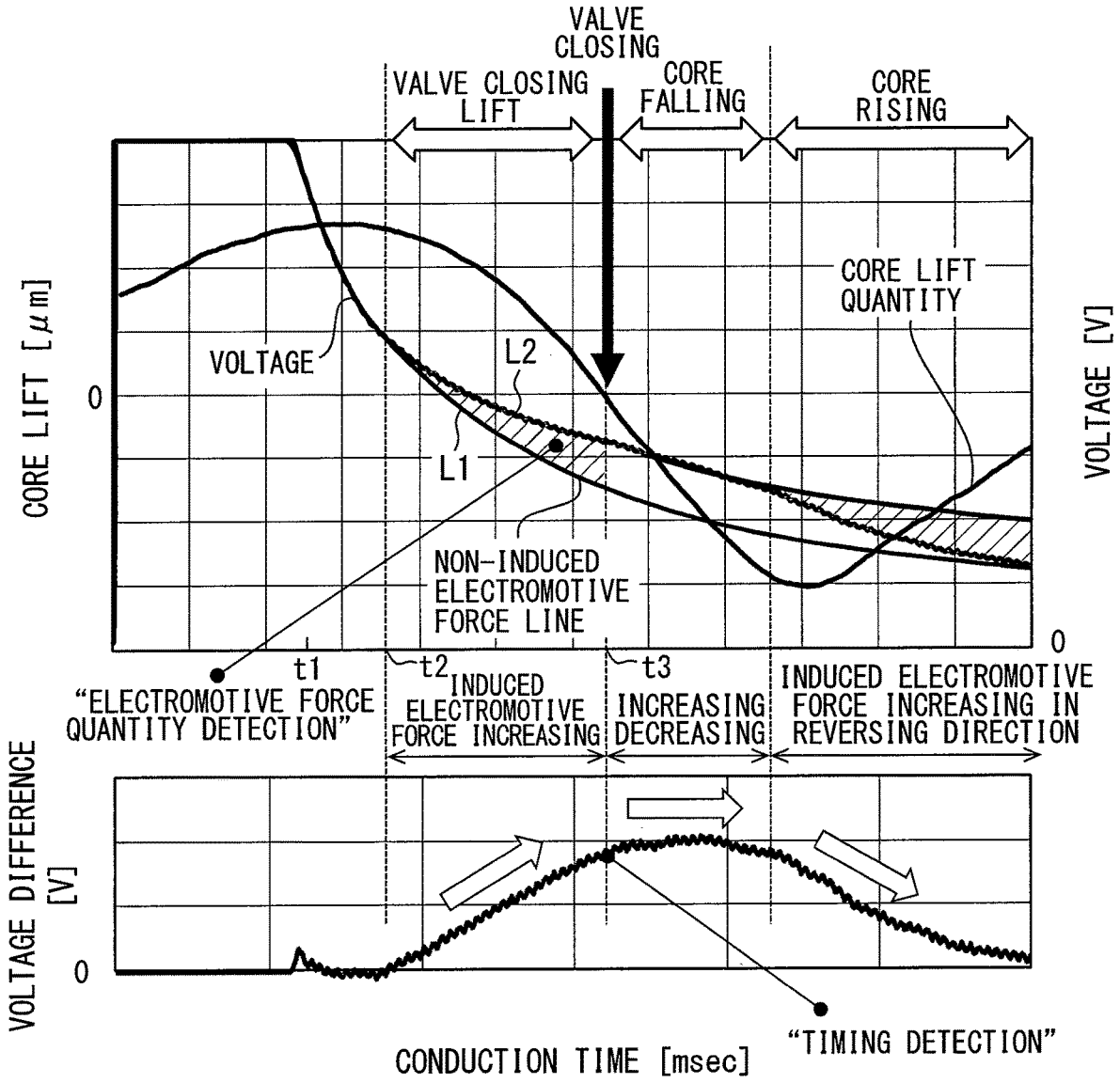
FIG. 4 is a graph showing the behavior of a valve body.

A detection mode of the valve closing detection unit 54 is explained hereunder in reference to FIG. 4. The graph at the upper part in FIG. 4 shows a waveform of minus terminal voltage of the electromagnetic coil 13 after conduction is switched from on to off and enlargedly shows a waveform of flyback voltage when conduction of the electromagnetic coil 13 is switched off. The flyback voltage is a negative value and hence is shown upside down in FIG. 4. In other words, a waveform of voltage obtained by reversing the positive and negative is shown in FIG. 4.

The valve closing detection unit 54 detects a physical quantity having a correlation with an injection quantity actually injected (actual injection quantity) during partial lift injection. The valve closing detection unit 54 has a timing detection unit 54*a* to detect a valve closing timing by a timing detection mode, an electromotive force quantity detection unit 54*b* to detect a valve closing timing by an electromotive force quantity detection mode, and a selection switch unit 54*c* to select and switch either of the detection modes. The valve closing detection unit 54 cannot detect a valve closing timing by both of the detection modes simultaneously and detects a valve closing timing when the valve body 12 shifts to valve closing by using either of the detection modes.

Firstly, an electromotive force quantity detection mode is explained.

Roughly, an electromotive force quantity detection mode is a mode of detecting a timing (integrated timing) when an integrated value of induced electromotive force reaches a prescribed quantity as a physical quantity having a correlation with an actual injection quantity. A timing when the valve body 12 is actually seated over the valve seat 17*b* for valve closing (actual valve closing timing) and an integrated timing are highly correlated. Then a timing when the valve body 12 separates actually from the valve seat 17*b* for valve opening (actual valve opening timing): is highly correlated with a conduction start timing; and hence can be regarded as a known timing. It can therefore be said that, as long as an integrated timing having a high correlation with an actual valve closing timing is detected, a period of time spent for actual injection (actual injection period) can be estimated and eventually an actual injection quantity can be estimated. In other words, it can be said that an integrated timing is a physical quantity having a correlation with an actual injection quantity.

Meanwhile, as shown in FIG. 4, minus terminal voltage varies by induced electromotive force after the time t1 when an injection command pulse is turned off. When a detected voltage waveform (refer to the symbol L1) is compared with a voltage waveform (refer to the symbol L2) in a virtual case where induced electromotive force is not generated, it is obvious that, in the detected voltage waveform, the voltage increases by the induced electromotive force shown with the oblique lines in FIG. 4. The induced electromotive force is generated when the movable core 15 passes through a magnetic field during the period from the start of valve closing operation to the completion of the valve closing.

Since the change rate of the valve body 12 and the change rate of the movable core 15 vary comparatively largely and the change characteristic of a minus terminal voltage varies at the valve closing timing of the valve body 12, the change characteristic of a minus terminal voltage varies in the vicinity of the valve closing timing. That is, the voltage waveform takes a shape of generating an inflection point (voltage inflection point) at a valve closing timing. Then a timing of generating a voltage inflection point is highly correlated with an integrated timing.

By paying attention to such a characteristic, the electromotive force quantity detection unit 54*b* detects a voltage inflection point time as information related to the integrated timing having a high relation with a valve closing timing as follows. The detection of a valve closing timing shown below is executed for each of the cylinders. The electromotive force quantity detection unit 54*b* calculates a first filtered voltage Vsm1 obtained by filtering (smoothing) a minus terminal voltage Vm of the fuel injection valve 10 with a first low-pass filter during the implementation of partial lift injection at least after an injection command pulse of the partial lift injection is switched off. The first low-pass filter uses a first frequency lower than the frequency of a noise component as the cut-off frequency. Further, the valve closing detection unit 54 calculates a second filtered voltage Vsm2 obtained by filtering (smoothing) the minus terminal voltage Vm of the fuel injection valve 10 with a second low-pass filter using a second frequency lower than the first frequency as the cut-off frequency. As a result, the first filtered voltage Vsm1 obtained by removing a noise component from a minus terminal voltage Vm and the second filtered voltage Vsm2 used for voltage inflection point detection can be calculated.

Figure 5:
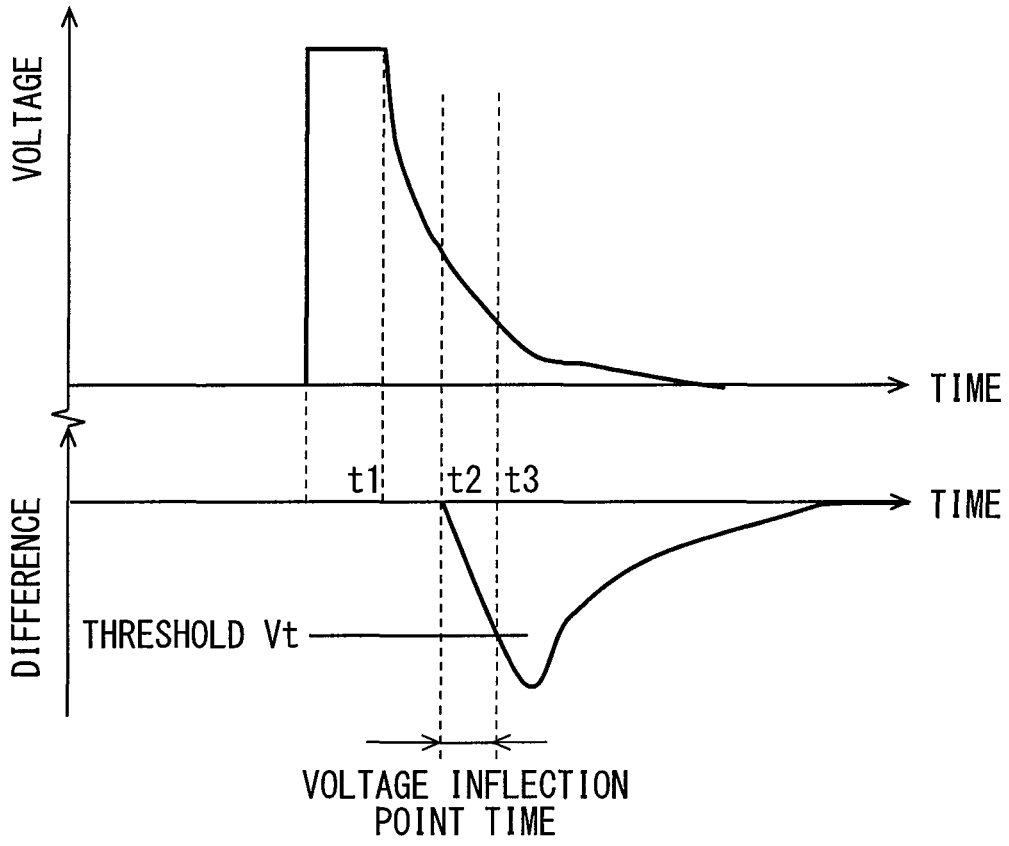
FIG. 5 is a graph showing a relationship between a voltage and a difference.

Further, the electromotive force quantity detection unit 54*b* calculates a difference Vdiff (=Vsm1−Vsm2) between the first filtered voltage Vsm1 and the second filtered voltage Vsm2. Furthermore, the valve closing detection unit 54 calculates a time from a prescribed reference timing to a timing when the difference Vdiff comes to be an inflection point as a voltage inflection point time Tdiff. On this occasion, as shown in FIG. 5, the voltage inflection point time Tdiff is calculated by regarding a timing when the difference Vdiff exceeds a prescribed threshold value Vt as a timing when the difference Vdiff comes to be an inflection point. In other words, a time from a prescribed reference timing to a timing when a difference Vdiff exceeds a prescribed threshold value Vt is calculated as the voltage inflection point time Tdiff. The difference Vdiff corresponds to an accumulated value of induced electromotive forces and the threshold value Vt corresponds to a prescribed reference quantity. The integrated timing corresponds to a timing where the difference Vdiff reaches the threshold value Vt. In the present embodiment, the voltage inflection point time Tdiff is calculated by regarding the reference timing as a time t2 when the difference is generated. The threshold value Vt is a fixed value or a value calculated by the control circuit 21 in response to a fuel pressure, a fuel temperature, and others.

In a partial lift region of the fuel injection valve 10, since an injection quantity varies and also a valve closing timing varies by the variation of a lift quantity of the fuel injection valve 10, there is a correlation between an injection quantity and a valve closing timing of the fuel injection valve 10. Further, since a voltage inflection point time Tdiff varies in response to the valve closing timing of the fuel injection valve 10, there is a correlation between a voltage inflection point time Tdiff and an injection quantity. By paying attention to such correlations, an injection command pulse correction routine is executed by the fuel injection control device 20 and hence an injection command pulse in partial lift injection is corrected on the basis of a voltage inflection point time Tdiff.

Secondly, a timing detection mode is explained.

Roughly, an electromotive force quantity detection mode is a mode of detecting a timing (integrated timing) when an integrated value of induced electromotive force reaches a prescribed quantity as a physical quantity having a correlation with an actual injection quantity. The timing detection unit 54*a* detects a timing when an increment of induced electromotive force per unit of time starts reducing as a valve closing timing.

The timing detection mode is explained hereunder. At a moment when the valve body 12 starts valve closing operation from a valve opening state and comes into contact with the valve seat 17*b*, since the movable core 15 separates from the valve body 12, the acceleration of the movable core 15 varies at the moment when the valve body 12 comes into contact with the valve seat 17*b*. In the timing detection mode, a valve closing timing is detected by detecting the variation of the acceleration of the movable core 15 as the variation of an induced electromotive force generated in the electromagnetic coil 13. The variation of the acceleration of the movable core 15 can be detected by a second-order differential value of a voltage detected by the voltage detection unit 23.

Specifically, as shown in FIG. 4, after the conduction to the electromagnetic coil 13 is stopped at the time t1, the movable core 15 switches from upward displacement to downward displacement in conjunction with the valve body 12. Then when the movable core 15 separates from the valve body 12 after the valve body 12 shifts to valve closing, a force in the valve closing direction that has heretofore been acting on the movable core 15 through the valve body 12, namely a force caused by a load by the main spring SP1 and a fuel pressure, disappears. A load of the sub spring SP2 therefore acts on the movable core 15 as a force in the valve opening direction. When the valve body 12 reaches a valve closing position and the direction of the force acting on the movable core 15 changes from the valve closing direction to the valve opening direction, the increase of an induced electromotive force that has heretofore been increasing gently reduces and the second-order differential value of a voltage turns downward at the valve closing time t3. By detecting a timing where the second-order differential value of a minus terminal voltage becomes maximum by the timing detection unit 54*a*, a valve closing timing of the valve body 12 can be detected with a high degree of accuracy.

Similarly to the electromotive force quantity detection mode, there is a correlation between a valve closing time from the stop of conduction to a valve closing timing and an injection quantity. By paying attention to such a correlation, an injection command pulse correction routine is executed by the fuel injection control device 20 and thus an injection command pulse in partial lift injection is corrected on the basis of the valve closing time.

Figure 6:
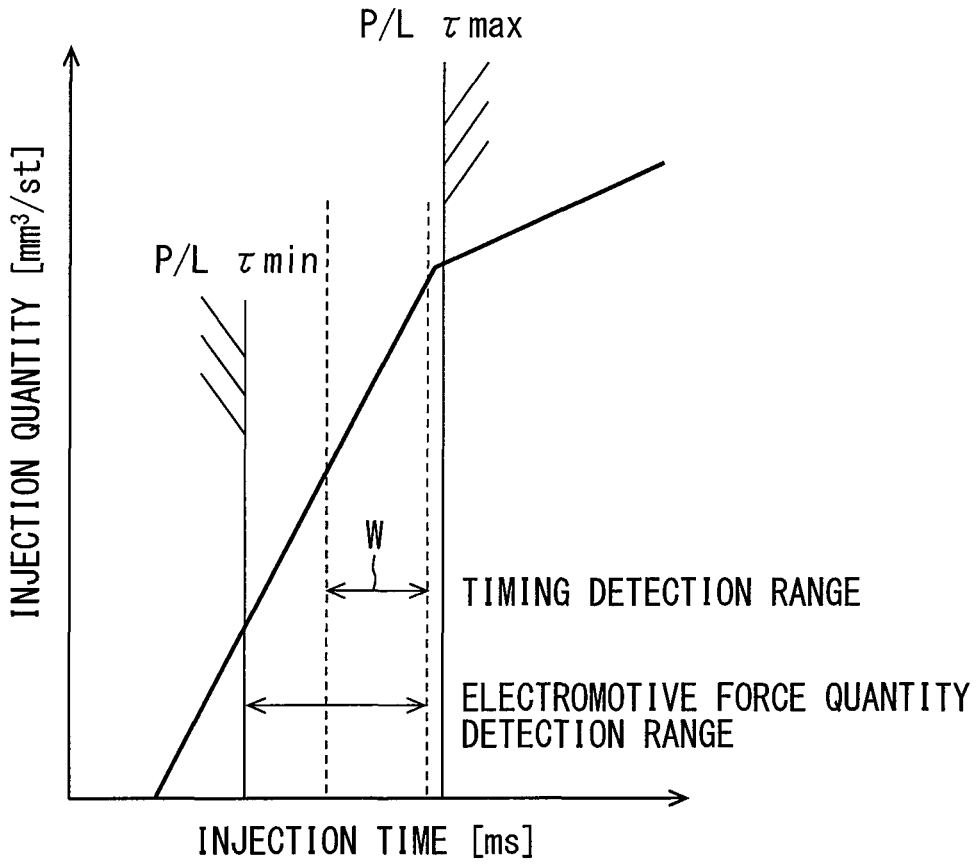
FIG. 6 is a graph for explaining a detection range.

As shown in FIG. 6, an injection time varies in response to a requested injection quantity. Then in a partial lift region, the detection range of the electromotive force quantity detection mode and the detection range of the timing detection mode are different from each other. Specifically, the detection range of the timing detection mode is located on the side where a required injection quantity is larger than a reference ratio in the partial lift region. The electromotive force quantity detection mode covers from a minimum injection quantity Tmin to a value in the vicinity of a maximum injection quantity Tmax. The detection range of the electromotive force quantity detection mode therefore includes the detection range of the timing detection mode and is wider than the detection range of the timing detection mode. The detection accuracy of a valve closing timing in the timing detection mode however is superior. In short, the present inventors have obtained the knowledge that the electromotive force quantity detection mode has a larger detection range than the timing detection mode and the timing detection mode has a higher degree of detection accuracy than the electromotive force quantity detection mode. On the basis of the knowledge, the selection switch unit 54*c* selects and switches either of the detection modes.

The injection quantity estimation unit 55 estimates an actual injection quantity on the basis of a detection result of the valve closing detection unit 54. For example, in the case of the timing detection mode, the injection quantity estimation unit 55 estimates an actual injection quantity on the basis of a detection result of the timing detection unit 54*a*, namely a timing when the second-order differential value of a minus terminal voltage comes to be the maximum. Specifically, a relationship among a timing when a second-order differential value comes to be the maximum, a conduction time, a supplied fuel pressure, and an actual injection quantity is stored as a timing detection map beforehand. Then the injection quantity estimation unit 55 estimates an actual injection quantity in reference to the timing detection map on the basis of a detection value of the timing detection unit 54*a*, a supplied fuel pressure detected by the fuel pressure sensor 31, and a conduction time.

Meanwhile, in the electromotive force quantity detection mode for example, the injection quantity estimation unit 55 estimates an actual injection quantity on the basis of a detection result of the electromotive force quantity detection unit 54*b*, namely a voltage inflection point time. Specifically, a relationship among a voltage inflection point time, a conduction time, a supplied fuel pressure, and an actual injection quantity is stored as an electromotive force quantity detection map beforehand. Then the injection quantity estimation unit 55 estimates an actual injection quantity in reference to the electromotive force quantity detection map on the basis of a detection value of the electromotive force quantity detection unit 54*b*, a supplied fuel pressure detected by the fuel pressure sensor 31, and a conduction time.

FIGS. 7 to 10 are flowcharts showing the procedures through which a processor in the control circuit 21 executes out programs stored in a memory in the control circuit 21 repeatedly in a prescribed cycle.

Figure 7:
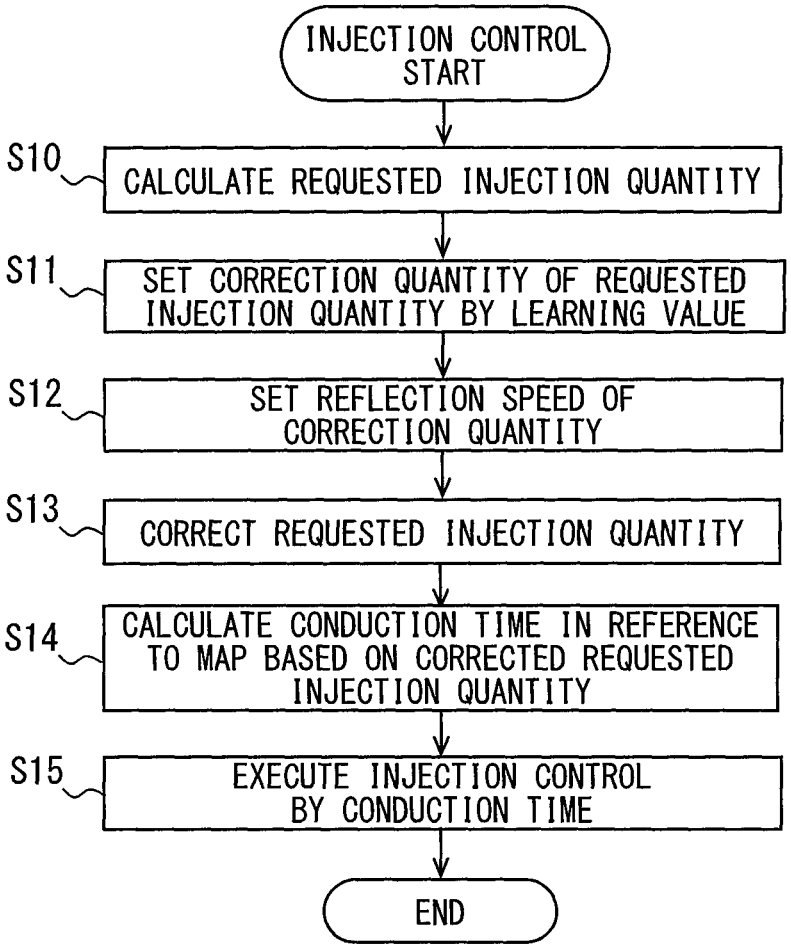
FIG. 7 is a flowchart showing injection control processing.

In the processing of injection control shown in FIG. 7, firstly at 510, a requested injection quantity is calculated on the basis of a load and a machine rotational speed of an internal combustion engine E. At S11, a correction quantity of the requested injection quantity calculated at 510 is set by using a learning value obtained through the processing of FIGS. 8 and 9. The correction quantity is set in accordance with a deviation between an actual injection quantity estimated by the injection quantity estimation unit 55 and the requested injection quantity. Although the deviation is directly used as the correction quantity in the present embodiment, a value obtained by multiplying a deviation by a prescribed coefficient may be used as a correction quantity.

At S12, a reflection speed of reflecting a correction quantity set at S11 on a requested injection quantity gradually for a prescribed period of time is set. Specifically, a reflection speed is set by executing the subroutine processing in FIG. 10 by a processor. At S13, a requested injection quantity is corrected by a correction quantity. Here, a correction quantity is not reflected immediately but is reflected at a reflection speed set at S12 gradually for a prescribed period of time. Specifically, a corrected requested injection quantity is obtained by adding a correction quantity to a requested injection quantity. Here, an obtained correction quantity is added to the next requested injection quantity not directly but dividedly in a prescribed number of times. The number of times is called a smoothing number of times and the smoothing number of times corresponds to a reflection speed. For example, when a smoothing number of times is 100, a correction quantity is divided into 100 parts and the divided 100 parts of the correction quantity are added to 100 requested injection quantities respectively. As a result, a correction quantity is reflected on requested injection quantities gradually by taking time required of injection of 100 times.

Here, an injection characteristic map representing a relationship between a conduction time and an injection quantity is stored in the control circuit 21 beforehand. Then at S14, a conduction time corresponding to the corrected requested injection quantity calculated at S13 is calculated in reference to the injection characteristic map. As the injection characteristic map, a plurality of maps are stored in response to supplied fuel pressures detected by the fuel pressure sensor 31 and a conduction time is calculated in reference to an injection characteristic map corresponding to a supplied fuel pressure of every moment.

At S15, the electromagnetic coil 13 is conducted on the basis of a conduction time calculated at S14. Specifically, a pulse width of an injection command pulse is set as a length of a calculated conduction time.

Here, the control circuit 21 during the process of S14 corresponds to a conduction time calculation unit to calculate a conduction time of an electric actuator corresponding to a requested injection quantity. The control circuit 21 during the process of S13 corresponds to a correction unit to correct a requested injection quantity by a correction quantity corresponding to a deviation between an actual injection quantity and the requested injection quantity. The control circuit 21 during the process of S12 corresponds to a reflection speed setting unit to set a reflection speed when the correction unit reflects a correction quantity on a requested injection quantity gradually for a prescribed period of time.

Figure 8:
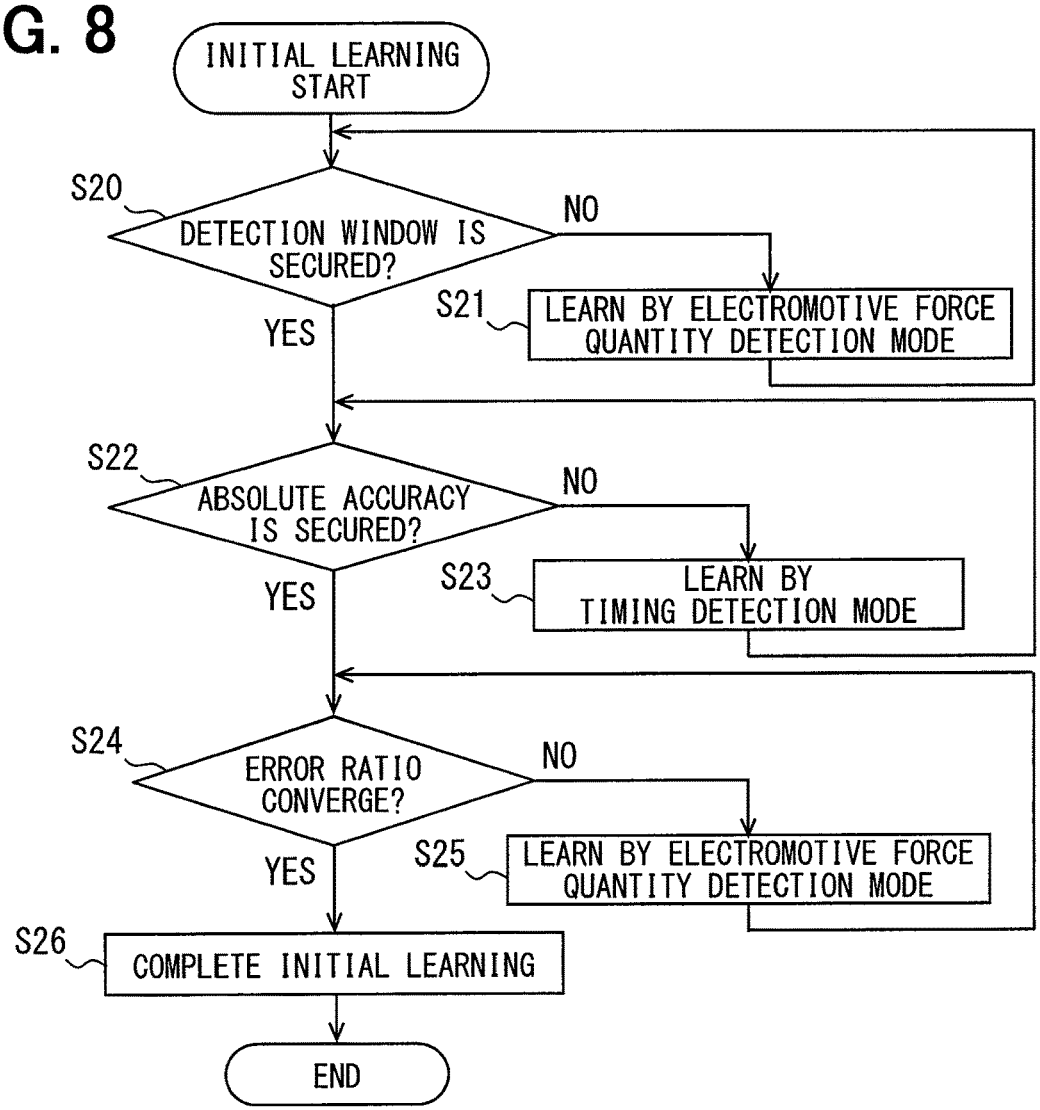
FIG. 8 is a flowchart showing initial learning processing.
Figure 9:
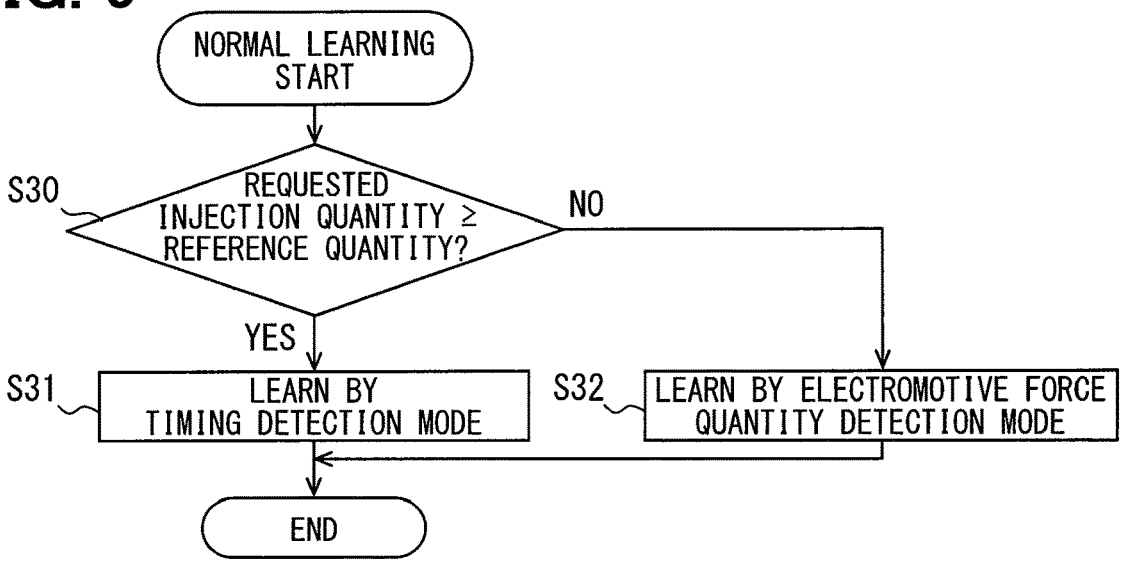
FIG. 9 is a flowchart showing ordinary learning processing.

At the processing of initial learning shown in FIG. 8 and ordinary learning shown in FIG. 9, a learning value used at S11 in FIG. 7, namely a correction quantity to correct a requested injection quantity, is obtained. Specifically, a correction quantity of a requested injection quantity is calculated for learning on the basis of a deviation between an actual injection quantity estimated on the basis of a detection result of the valve closing detection unit 54 and an injection quantity corresponding to a command conduction time related to the actual injection, namely a corrected requested injection quantity. In the present embodiment, a deviation is used directly as a correction quantity and the correction quantity is set: at a negative value in order to reduce the next requested injection quantity when an actual injection quantity is larger than a requested injection quantity; and at a positive value in order to increase the next requested injection quantity when an actual injection quantity is smaller than a requested injection quantity.

Meanwhile, during an initial period when the operating time of an internal combustion engine E is short and the frequency of detection by the valve closing detection unit 54 is few or an initial period when the fuel injection control device 20 or the fuel injection valve 10 is just exchanged, the estimation accuracy of an actual injection quantity is poor because a learning quantity is insufficient. In order to improve estimation accuracy rapidly to cope with that, initial learning shown in FIG. 8 is executed during the initial period of learning in view of the aforementioned knowledge shown in FIG. 6. Successively, after the estimation accuracy improves to some extent by continuing the initial learning, the initial learning is switched to ordinary learning shown in FIG. 9.

Firstly, at S20 in FIG. 8, whether or not the estimation accuracy of an actual injection quantity by the injection quantity estimation unit 55 is lower than a prescribed first degree of accuracy is determined. For example, the first degree of accuracy is set as estimation accuracy of the extent of being able to control an actual injection quantity within a detection window W that is a large region of an injection region in partial lift injection on the side larger than a reference injection quantity.

When the estimation accuracy is determined to be lower than the first degree of accuracy, the process proceeds to S21 on the assumption that the situation is in the state of not being able to control an actual injection quantity within the detection window W, in other words, in the state where a detection window is not secured. At S21, regardless of whether or not a requested injection quantity is in the detection window W, a valve closing timing is detected by the electromotive force quantity detection mode. In other words, the selection switch unit 54*c* selects the electromotive force quantity detection unit 54*b*. As a result, during a first period until a detection window W is secured, an actual injection quantity is estimated on the basis of a detection result of the electromotive force quantity detection mode and a correction quantity is calculated for learning on the basis of a deviation between the estimated actual injection quantity and a requested injection quantity. Then the next and succeeding requested injection quantities during the first period are corrected on the basis of the correction quantities that have heretofore been learned.

As the correction during the first period is repeated and a learning quantity increases, the estimation accuracy of an actual injection quantity improves and a deviation reduces. As a result, at S20, when the estimation accuracy is determined to have reached the first degree of accuracy, the process proceeds to S22 on the assumption that a detection window W is secured and the learning during the first period by the electromotive force quantity detection mode has been completed.

At S22, whether or not the estimation accuracy of an actual injection quantity by the injection quantity estimation unit 55 is lower than a second degree of accuracy (absolute accuracy) is determined. The second degree of accuracy is set at a degree higher than the first degree of accuracy. For example, the second degree of accuracy is regarded as having been reached when a state where a deviation between an actual injection quantity and a requested injection quantity has reached a prescribed quantity lasts prescribed times or more.

When the estimation accuracy is determined to be lower than the second degree of accuracy, the process proceeds to S23 by regarding the situation as a state where the absolute accuracy is not secured and a valve closing timing is detected by the timing detection mode on condition that a requested injection quantity is in the detection window W. That is, the selection switch unit 54*c* selects the timing detection unit 54*a*. As a result, during a second period until the absolute accuracy is secured, an actual injection quantity is estimated on the basis of a detection result of the timing detection mode and a correction quantity is calculated for learning on the basis of a deviation between the estimated actual injection quantity and a requested injection quantity. Then the next and succeeding requested injection quantities during the second period are corrected on the basis of the correction quantities that have heretofore been learned. In the learning at S23, the timing detection mode may be selected when a requested injection quantity related to partial lift injection is in a detection window W or a requested injection quantity related to partial lift injection may be set forcibly so as to be an injection quantity in a detection window W.

As the correction during the second period is repeated and a learning quantity increases, the estimation accuracy of an actual injection quantity improves and a deviation reduces. As a result, at S22, when the estimation accuracy is determined to have reached the second degree of accuracy, the process proceeds to S24 on the assumption that the absolute accuracy is secured and the learning during the second period by the timing detection mode has been completed.

At S24, whether or not the estimation accuracy of an actual injection quantity by the injection quantity estimation unit 55 is lower than a third degree of accuracy is determined. The third degree of accuracy is set at a degree equal to or higher than the second degree of accuracy. For example, the estimation accuracy is determined to have reached the third degree of accuracy when an error ratio calculated on the basis of a deviation between an actual injection quantity and a requested injection quantity converges in a prescribed range. The error ratio is calculated as a ratio of the sum of a corrected flow rate and a flow rate this time to a requested injection quantity. For example, an error ratio is calculated through the following expression (1). Here, the corrected flow rate is a value obtained by dividing a requested injection quantity by a previous error ratio. An error flow rate is a value representing a deviation and is the difference between a requested injection quantity and an estimated injection quantity.

$$\text{Error ratio } K = \text{Requested flow rate}/\{\text{Corrected flow rate} + \text{Error flow rate this time}\} = \text{Requested flow rate}/\{(\text{Requested flow rate}/\text{Previous error ratio}) + \text{Error flow rate this time}\} \quad (1)$$

The case where the error ratio converges means for example the case where a state of keeping an error ratio within a prescribed range lasts for a certain period of time. Since a previous error ratio is involved in the calculation of an error ratio shown in the expression (1), the estimation accuracy of the actual injection quantity is improved by making an error ratio converge.

When the estimation accuracy is determined to be lower than the third degree of accuracy, the process proceeds to S25 and a valve closing timing is detected by the electromotive force quantity detection mode regardless of whether or not a requested injection quantity is in a detection window W. In other words, the selection switch unit 54*c* selects the electromotive force quantity detection unit 54*b*. As a result, during a third period until an error ratio converges in a prescribed range, an actual injection quantity is estimated on the basis of a detection result of the electromotive force quantity detection mode and a correction quantity is calculated for learning on the basis of a deviation between the estimated actual injection quantity and a requested injection quantity. Then the next and succeeding requested injection quantities during the third period are corrected on the basis of the correction quantities that have heretofore been learned.

As the correction during the third period is repeated and a learning quantity increases, the estimation accuracy of an actual injection quantity improves and a deviation reduces. As a result, at S24, when the estimation accuracy is determined to have reached the third degree of accuracy, the process proceeds to S26 on the assumption that an error ratio has converged in a prescribed range and the learning during the third period by the electromotive force quantity detection mode has been completed. At S26, an initial learning completion flag representing that the initial period including the first period, the second period, and the third period has been completed is turned on.

In short, it can be said that a detection result of the electromotive force quantity detection mode is corrected by using a detection result of the timing detection mode of good detection accuracy during the third period. Meanwhile, during the first period until a detection window W is secured, learning is executed by the electromotive force quantity detection mode having a wide detectable range.

After the initial learning shown in FIG. 8 is completed, a correction quantity based on a deviation between an actual injection quantity and a requested injection quantity is calculated for learning by the ordinary learning shown in FIG. 9. Firstly, at S30 in FIG. 9, whether or not a requested injection quantity is equal to or larger than a reference quantity is determined. The required injection quantity used for the determination is a requested injection quantity after corrected by using correction quantities obtained through preceding learning. When a requested injection quantity is determined to be equal to or larger than the reference quantity, the process proceeds to S31 and, similarly to S23 in FIG. 8, a valve closing timing is detected for learning by the timing detection mode. When the requested injection quantity is determined to be not equal to or larger than the reference quantity, the process proceeds to S32 and, similarly to S25 in FIG. 8, a valve closing timing is detected for learning by the electromotive force quantity detection mode.

Figure 10:
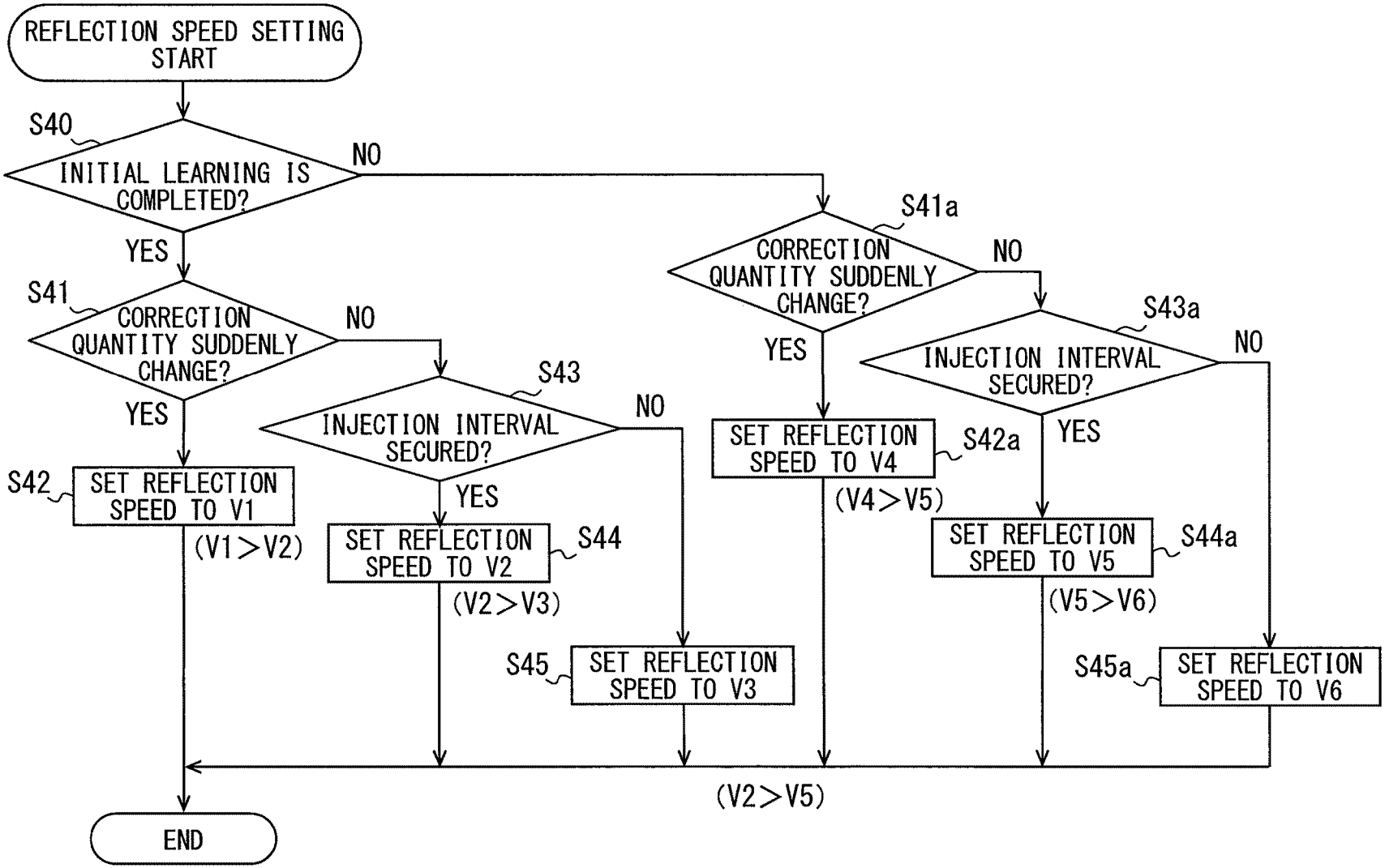
FIG. 10 is a flowchart showing reflection speed setting processing.

The processing shown in FIG. 10 is the subroutine processing at S12 in FIG. 7 and is processing of setting a reflection speed stated earlier. Firstly at S40 in FIG. 10, whether or not the initial learning through the processing of FIG. 8 is in the state of being completed is determined. When the initial learning is determined to have been completed, at S41, whether or not a correction quantity is in a sudden change state that is the state of suddenly changing is determined. Specifically, when a correction quantity changes by a prescribed quantity or more from the previous quantity and the state of changing by the prescribed quantity or more lasts for a period of time required of injection of a prescribed number of times, the correction quantity is determined to be in the sudden change state. When the correction quantity is determined to be in the sudden change state, at S42, the reflection speed is set at a first speed V1 that has been set beforehand.

When the correction quantity is determined not to be in the sudden change state at S41, at S43, whether or not injection intervals during multi injection are secured for a prescribed period of time or longer is determined. The multi injection means that a fuel is injected twice or more during one combustion cycle of an internal combustion engine E. An injection interval means an interval between the pulse width of an injection command pulse and the pulse width of an immediately succeeding injection command pulse and an off period of injection command pulses. When injection intervals are determined to be secured, at S44, the reflection speed is set at a second speed V2 that has been set beforehand. The second speed V2 is set at a value lower than the first speed V1. When the injection intervals are determined not to be secured at S43, at S45, the reflection speed is set at a third speed V3 that has been set beforehand. The third speed V3 is set at a value lower than the second speed V2.

In short, at S41 to S45, in setting a reflection speed on the basis of the sudden change state and the interval state, the reflection speed is set with priority given to the sudden change state rather than the interval state. In other words, as long as a correction quantity is in the sudden change state, the reflection speed is set at the first speed V1 regardless of the interval state.

When the initial learning is determined not to have been completed at S40, the determination similar to S41 and S43 stated earlier is executed at S41*a* and S43*a*. Then when the correction quantity is determined to have changed suddenly at S41*a*, at S42*a*, the reflection speed is set at a fourth speed V4 that has been set beforehand. When the correction quantity is determined not to be in the sudden change state at S41*a* and the injection intervals are determined to be secured at S43*a*, at S44*a*, the reflection speed is set at a fifth speed V5 that has been set beforehand. The fifth speed V5 is set at a value lower than the fourth speed V4. When the injection intervals are determined not to be secured at S43*a*, at S45*a*, the reflection speed is set at a sixth speed V6 that has been set beforehand. The sixth speed V6 is set at a value lower than the fifth speed V5. Further, the fifth speed V5 used at S44*a* is set at a value lower than the second speed V2 used at S44.

In short, at S41*a* to S45*a*, in setting a reflection speed on the basis of the sudden change state and the interval state, the reflection speed is set with priority given to the sudden change state rather than the interval state. In other words, as long as a correction quantity is in the sudden change state, the reflection speed is set at the fourth speed V4 regardless of the interval state. Here, the control circuit 21 during the processes of S41 and S41*a* corresponds to a sudden change determination unit to determine whether or not a correction quantity is in a sudden change state that is a state where the correction quantity has changed suddenly. The control circuit 21 during the processes of S43 and S43*a* corresponds to an interval determination unit to determine whether or not an interval is equal to or greater than a prescribed time (i.e. secured).

As explained above, in the present embodiment, a requested injection quantity is corrected by a correction quantity corresponding to a deviation between an actual injection quantity and the requested injection quantity and, when the correction quantity is in the state of changing suddenly, a reflection speed of reflecting the correction quantity on the requested injection quantity is increased. Consequently, when an injection characteristic changes in response to the exchange of the fuel injection valve 10, the situation is determined to be in a sudden change state and the reflection speed increases and hence a correction quantity that has changed suddenly by the exchange can be reflected rapidly. In the state, when an injection characteristic changes by aging, a correction unit at S13 reflects the correction quantity on a requested injection quantity gradually for a prescribed period of time. As a result, in reflecting a correction quantity that changes by aging, poor estimation accuracy in partial lift injection is hardly reflected. According to the present embodiment therefore, it is possible to attempt to deal with both of the change of an injection characteristic by aging and the exchange of the fuel injection valve 10.

In the present embodiment further, a sudden change determination unit at S41 and S41*a* determines a correction quantity to be in a sudden change state when the correction quantity changes by a prescribed quantity or more from the previous value and the state of changing by the prescribed quantity or more lasts for a prescribed period of time. Consequently, when a correction quantity changes by a prescribed quantity or more from the previous value, in comparison with the case of judging a correction quantity to be in a sudden change state without the condition of continuance for a prescribed period of time, the risk of misjudging the correction quantity to be in a sudden change state in spite of the fact that the fuel injection valve 10 is not exchanged can be reduced.

Meanwhile, a magnetic flux generated by conducting the electromagnetic coil 13 does not completely disappear simultaneously with the turnoff of the conduction, remains slightly even after the turnoff of the conduction, and disappears gradually. When an interval is extremely short therefore, a residual magnetic flux of previous injection influences the next injection undesirably and resultantly there is a risk of changing a valve opening time and an injection quantity.

In view of this point, in the present embodiment, when an injection interval is determined to be equal to or greater than a prescribed period of time by an interval determination unit at S43 and S43*a*, a reflection speed is set at a speed higher than a reflection speed when an injection interval is determined not to be secured. Specifically, in FIG. 10, the second speed V2 is set at a value higher than the third speed V3 and the fifth speed V5 is set at a value higher than the sixth speed V6. Consequently, since a reflection speed is increased on condition that an interval is secured sufficiently, it is possible to reduce the risk of getting into the situation of deteriorating injection accuracy by further increasing a reflection speed when injection accuracy deteriorates because of a residual magnetic flux. Besides, since the reflection speed is increased when the deterioration of injection accuracy caused by a residual magnetic flux does not exist, correction corresponding to the change of an injection characteristic by aging can be reflected rapidly.

Here, as stated earlier, the timing detection mode and the induced electromotive force detection mode have advantages and disadvantages respectively. It is desirable therefore to detect a valve closing timing simultaneously by both of the detection modes. In order to make it possible to execute both of the detection modes simultaneously however, the processing capability of the control circuit 21 has to be enhanced and the implementation scale of the fuel injection control device 20 may increase undesirably. In view of this point, the valve closing detection unit 54 according to the present embodiment has the timing detection unit 54*a* of the timing detection mode, the electromotive force quantity detection unit 54*b* of the induced electromotive force detection mode, and the selection switch unit 54*c* to select and switch either of the detection modes. Consequently, the valve closing detection unit 54 can switch so as to exhibit the advantages of both of the modes and can be downsized further than a configuration of executing both of the modes simultaneously.

In the present embodiment further, the selection switch unit 54*c* selects the electromotive force quantity detection unit 54*b* during the first period until a detection window W is secured. Successively, the selection switch unit 54*c* selects the timing detection unit 54*a* during the second period until absolute accuracy is secured. Successively, the selection switch unit 54*c* selects the electromotive force quantity detection unit 54*b* during the third period until an error ratio converges in a prescribed range.

According to this, since the electromotive force quantity detection unit 54*b* is selected during the first period before the timing detection unit 54*a* is selected during the second period, it is possible to avoid selecting the timing detection mode to injection that is not in a detection window W and deteriorating the detection accuracy. A period of time required until absolute accuracy is secured can therefore be shortened. Further, since the timing detection unit 54*a* is selected during the second period before the electromotive force quantity detection unit 54*b* is selected during the third period, a detection result of the electromotive force quantity detection unit 54*b* during the third period is corrected by using a highly accurate correction quantity obtained through the learning during the second period. In addition, in a region other than a detection window W therefore, a highly accurate correction quantity can be secured quickly. As a result, change to a lower limit time suitable for the actual change of an injection characteristic can be done with a high degree of accuracy.

In the present embodiment further, during the ordinary period after initial learning is completed, the selection switch unit 54*c*: selects the timing detection unit 54*a* when a requested injection quantity is larger than a reference injection quantity; and selects the electromotive force quantity detection unit 54*b* when a requested injection quantity is smaller than a reference injection quantity. According to this, a narrow detection range of the timing detection mode can be compensated by the electromotive force quantity detection mode and a detection result by the electromotive force quantity detection mode of low detection accuracy can be corrected by a detection result of the timing detection mode. Consequently, a fuel injection device capable of obtaining both of the detection accuracy and the detection range of a valve closing timing can be materialized. As a result, change to a lower limit time suitable for the actual change of an injection characteristic can be done with a high degree of accuracy.

In the present embodiment further, a reflection speed setting unit at S12 sets a reflection speed during the initial period of learning at a speed higher than a reflection speed during the ordinary period. Specifically, in FIG. 10, the second speed V2 is set at a value higher than the fifth speed V5. Consequently, since a reflection speed is increased on condition that the initial learning has been completed, it is possible to reduce the risk of getting into the situation of deteriorating injection accuracy by further increasing a reflection speed under the circumference where injection accuracy deteriorates because the initial learning is not completed yet. Besides, since the reflection speed is increased under the circumference where the deterioration of injection accuracy caused by uncompleted initial learning does not exist, correction corresponding to the change of an injection characteristic by aging can be reflected rapidly.

Second Embodiment

In the first embodiment stated above, a deviation between an actual injection quantity and a requested injection quantity is used directly as a correction quantity. In contrast, in the present embodiment, with respect of the fuel injection valve 10 installed in each of cylinders, the extent of a deviation of the injection characteristic of the relevant fuel injection valve 10 from the injection characteristic of a nominal fuel injection valve is calculated for each of the cylinders. For example, during a prescribed conduction time, the ratio of an actual injection quantity of a relevant fuel injection valve 10 to an injection quantity of a nominal valve is calculated as a deviation ratio per cylinder. Further, an average value of the deviation ratios per cylinder of fuel injection valves 10 is calculated as an average deviation ratio.

Figure 11:
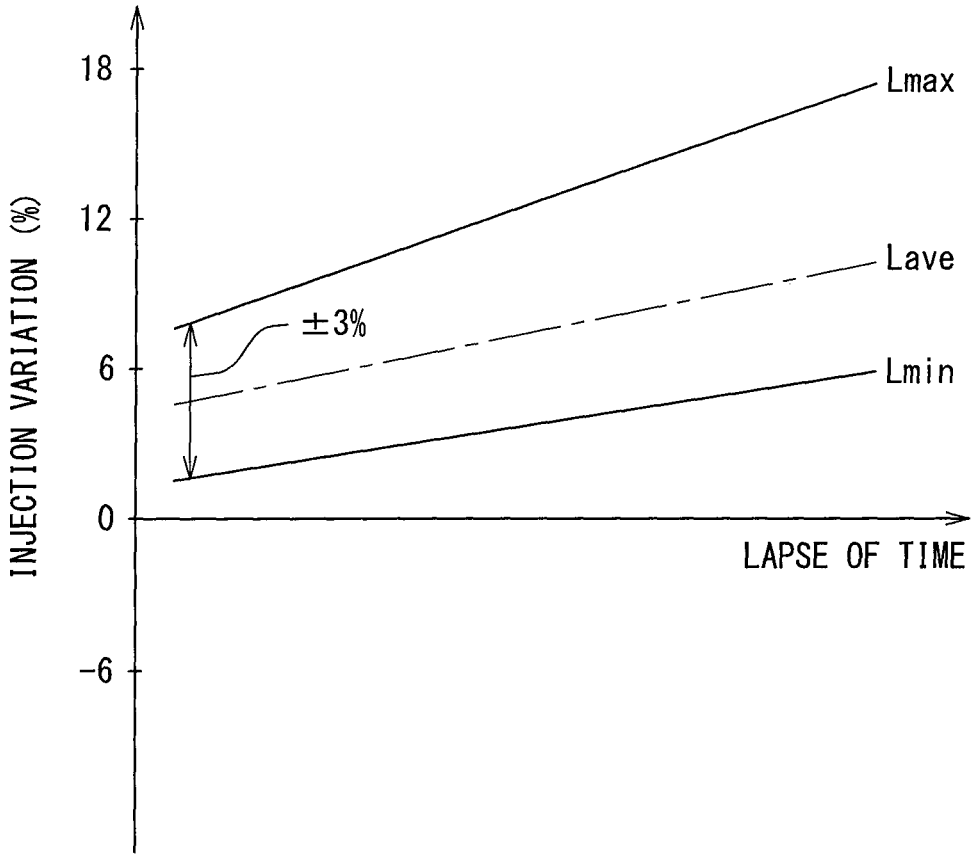
FIG. 11 is a view showing the state where the variation of an injection characteristic for each fuel injection valve changes with the lapse of time.

FIG. 11 shows an example of increasing an average deviation ratio Lave with the lapse of time. Further, FIG. 11 shows an example of increasing the deviation ratio per cylinder Lmax of a cylinder that deviates most and the deviation ratio per cylinder Lmin of a cylinder that deviates least among a plurality of deviation ratios per cylinder with the lapse of time. Although the maximum deviation ratio per cylinder Lmax and the minimum deviation ratio per cylinder Lmin are in the range of −3% to +3% of the average deviation ratio Lave at an initial stage, the range expands with the lapse of time.

A correction quantity according to the present embodiment is calculated on the basis of a deviation ratio per cylinder and an average deviation ratio. For example, a value obtained by summing a value obtained by multiplying a deviation ratio per cylinder by a prescribed coefficient (for example, 0.8) and a value obtained by multiplying an average deviation ratio by a prescribed coefficient (for example, 0.2) is calculated as a correction quantity of a relevant fuel injection valve 10. A sudden change determination unit uses a correction quantity calculated on the basis of a deviation ratio per cylinder and an average deviation ratio in this way as an object for judging sudden change.

A reflection speed according to the present embodiment is set for either of a deviation ratio per cylinder and an average deviation ratio. Consequently, a reflection speed per cylinder that is a reflection speed set for a deviation ratio per cylinder and an average reflection speed that is a reflection speed set for an average deviation ratio may sometimes be set at different speeds. For example, when a correction quantity is determined to be in a sudden change state in the state where the initial learning is completed, a reflection speed per cylinder and an average reflection speed are set at the same speed. In contrast, when a correction quantity is determined to be in a sudden change state in the state where the initial learning is not completed, an average reflection speed is set so as to be higher than a reflection speed per cylinder.

Other Embodiments

The embodiment of the present disclosure has been described with reference to specific examples. However, the present disclosure is not limited to these specific examples. That is, ones obtained by modifying the design of these specific examples as appropriate by a person skilled in the art are also included in the scope of the present disclosure as long as they have the characteristics of the present disclosure.

In the first embodiment stated above, a deviation between an actual injection quantity and a requested injection quantity is used directly as a correction quantity and offset correction is executed by adding the correction quantity to the next and succeeding requested injection quantities. In contrast, it is also possible to: use a ratio of a deviation between an actual injection quantity and a requested injection quantity to the actual injection quantity or the requested injection quantity as a correction quantity (namely a correction coefficient); and execute correction by multiplying the next and succeeding requested injection quantities by the correction quantity.

Although the fuel injection valve 10 is configured so as to have the valve body 12 and the movable core 15 individually in the first embodiment stated earlier, the fuel injection valve 10 may also be configured so as to have the valve body 12 and the movable core 15 integrally. If they are configured integrally, the valve body 12 is displaced together with the movable core 15 in the valve opening direction and shifts to valve opening when the movable core 15 is attracted.

Although the fuel injection valve 10 is configured so as to start the shift of the valve body 12 at the same time as the start of the shift of the movable core 15 in the first embodiment stated earlier, the fuel injection valve 10 is not limited to such a configuration. For example, the fuel injection valve 10 may be configured so that: the valve body 12 may not start valve opening even when the movable core 15 starts shifting; and the movable core 15 may engage with the valve body 12 and start valve opening at the time when the movable core 15 moves by a prescribed distance.

Although the voltage detection unit 23 detects a minus terminal voltage of the electromagnetic coil 13 in the first embodiment stated above, a plus terminal voltage or a voltage across terminals between a plus terminal and a minus terminal may also be detected.

In the first embodiment stated above, the valve closing detection unit 54 detects a terminal voltage of the electromagnetic coil 13 as a physical quantity having a correlation with an actual injection quantity. Then the injection quantity estimation unit 55 estimates an actual injection quantity by estimating a valve closing timing on the basis of a waveform representing the change of the detected voltage. In contrast, an actual injection quantity may be estimated also by detecting a supplied fuel pressure as a physical quantity having a correlation with the actual injection quantity and estimating a valve closing timing on the basis of a waveform representing the change of the detected fuel pressure. Otherwise, an actual injection quantity may be estimated also on the basis of a waveform representing the change of an engine speed by detecting the engine speed as a physical quantity having a correlation with the actual injection quantity.

The functions exhibited by the fuel injection control device 20 in the first embodiment stated earlier may be exhibited by hardware and software, those being different from those stated earlier, or a combination of them. The control device for example may communicate with another control device and the other control device may implement a part or the whole of processing. When a control device includes an electronic circuit, the control device may include a digital circuit or an analog circuit including many logic circuits.

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

The invention claimed is:

1. A fuel injection control device that is applied to a fuel injection valve for opening, by an electric actuator, a valve body to open and close an injection hole to inject a fuel, controls an opening time of the valve body by controlling the electric actuator, and thus controls an injection quantity injected per one opening of the valve body, the fuel injection control device comprising:

a processor programmed to:

calculate a conduction time of the electric actuator corresponding to a requested injection quantity that is an injection quantity requested during partial lift injection in which the valve body starts closing before the valve body reaches a maximum valve opening position after the valve body starts opening;

detect a physical quantity having a correlation with an actual injection quantity that is an injection quantity actually injected during the partial lift injection;

estimate the actual injection quantity based on the detected physical quantity;

correct the requested injection quantity by a correction quantity corresponding to a deviation between the estimated actual injection quantity and the requested injection quantity;

determine whether or not the correction quantity is in a sudden change state based on whether or not the correction quantity has changed from a previous value by a prescribed quantity or more;

set a reflection speed at which the the correction quantity is gradually reflected on the requested injection quantity over a prescribed period of time; and when the correction quantity is determined to be in the sudden change state, increase the reflection speed.

2. The fuel injection control device according to claim 1, wherein the processor is programmed to:

determine the correction quantity to be in the sudden change state when the correction quantity changes from a previous value by the prescribed quantity or more and the state of changing by the prescribed quantity or more lasts for a prescribed period of time.

3. The fuel injection control device according to claim 1, wherein when multi-injection of injecting a fuel twice or more during one combustion cycle of an internal combustion engine is executed, an interval of the twice or more injection is called an injection interval, and the processor is programmed to:

determine that the injection interval is secured when the injection interval is greater than or equal to a prescribed period of time; and when the injection interval is determined to be secured, increase the reflection speed.

4. The fuel injection control device according to claim 1, wherein the electric actuator includes an electromagnetic coil and a movable core to shift by being attracted by an electromagnetic force generated by energizing the electromagnetic coil, the valve body is connected to the movable core and operates for opening by an opening force given from the movable core shifting in accordance with conduction, and the processor is programmed to:

detect an induced electromotive force generated in the electromagnetic coil as the valve body closes together with the movable core after the conduction of the electromagnetic coil stops;

detect a timing when an increment of the induced electromotive force per unit of time starts reducing as a first type of the physical quantity;

detect a timing when an integrated value of the induced electromotive force reaches a prescribed quantity as a second type of the physical quantity; and select and switch either of the first and second type of the physical quantity.

5. The fuel injection control device according to claim 4, wherein the processor is programmed to:

during a first period when an estimation accuracy is lower than a first degree of accuracy, select the second type of physical quantity;

when the estimation accuracy during the first period improves up to the first degree of accuracy, shift from the first period to a second period and select the first type of physical quantity on condition that the requested injection quantity is in a large region on a larger side of an injection region of the partial lift injection than a reference injection quantity; and when the estimation accuracy, when the requested injection quantity is in the large region during the second period, improves up to a second degree of accuracy set at a degree higher than the first degree of accuracy, shift from the second period to a third period and select the second type of physical quantity.

6. The fuel injection control device according to claim 5, wherein the processor is programmed to:

when the estimation accuracy by the during the third period improves up to a third degree of accuracy set at a degree higher than the second degree of accuracy, finish an initial period including the first period, the second period, and the third period and shift to an ordinary period; and during the ordinary period, select the first type of physical quantity when the requested injection quantity is larger than the reference injection quantity and select the second type of physical quantity when the requested injection quantity is smaller than the reference injection quantity.

7. The fuel injection control device according to claim 6, wherein the processor is programmed to increase the reflection speed during the initial period over the ordinary period.

* * * * *